US011971189B2

(12) United States Patent
Kim et al.

(10) Patent No.: US 11,971,189 B2
(45) Date of Patent: Apr. 30, 2024

(54) AIR CONDITIONER

(71) Applicant: LG ELECTRONICS INC., Seoul (KR)

(72) Inventors: Beomchan Kim, Seoul (KR); Jusu Kim, Seoul (KR); Eunseong Pack, Seoul (KR); Yeongpin Chu, Seoul (KR); Janghoon Shin, Seoul (KR); Jaeik Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 24 days.

(21) Appl. No.: 17/550,082

(22) Filed: Dec. 14, 2021

(65) Prior Publication Data

US 2022/0186972 A1 Jun. 16, 2022

(30) Foreign Application Priority Data

Dec. 15, 2020 (KR) ..... 10-2020-0175433

(51) Int. Cl.
*F24F 12/00* (2006.01)
*F24F 1/0035* (2019.01)
(Continued)

(52) U.S. Cl.
CPC ..... *F24F 12/00* (2013.01); *F24F 1/0035* (2019.02); *F24F 1/0083* (2019.02);
(Continued)

(58) Field of Classification Search
CPC ..... F24F 1/0083; F24F 3/1405; F24F 3/153; F24F 2003/1452; F24F 12/00; F24F 13/222; F24F 2013/225; B60H 1/32331
See application file for complete search history.

(56) References Cited

U.S. PATENT DOCUMENTS 2,759,334 A * 8/1956 Burgess ..... F24F 3/001 62/509
3,651,660 A * 3/1972 Quiros ..... F24F 1/027 62/279

(Continued)

FOREIGN PATENT DOCUMENTS

KR 10-0902502 6/2009
KR 10-1337942 12/2013

*Primary Examiner* — Christopher R Zerphey
(74) *Attorney, Agent, or Firm* — KED & ASSOCIATES

(57) ABSTRACT

An air conditioner may include an outdoor unit including a compressor and an outdoor heat exchanger configured to heat exchange compressed refrigerant; an indoor unit having an air inlet and an air outlet and connected with the outdoor unit through a first pipe through which refrigerant discharged from the compressor flows and a second pipe through which refrigerant discharged from the outdoor heat exchanger flows; a blowing fan disposed in the indoor unit; a main heat exchanger configured to heat exchange air, which flows inside through the air inlet, and connected with the second pipe; a reheat exchanger disposed downstream of the main heat exchanger and connected with the first pipe; and a waste heat exchanger disposed upstream of the main heat exchanger and configured to heat-exchange air, which flows inside through the air inlet, and condensate water, which is produced at the main heat exchanger, with each other. Accordingly, air flowing inside through the air inlet is primarily cooled before exchanging heat through the main heat exchanger, whereby the cooling and dehumidifying performance is improved.

15 Claims, 8 Drawing Sheets

(51) Int. Cl.

| | |
|---|---|
| ***F24F 1/0083*** | (2019.01) |
| ***F24F 3/14*** | (2006.01) |
| ***F24F 3/153*** | (2006.01) |
| ***F24F 13/22*** | (2006.01) |
| ***F24F 13/30*** | (2006.01) |

(52) U.S. Cl.
CPC ..... *F24F 3/1405* (2013.01); *F24F 3/153* (2013.01); *F24F 13/222* (2013.01); *F24F 13/30* (2013.01); *F24F 2003/1452* (2013.01)

(56) References Cited

U.S. PATENT DOCUMENTS

| | | | | |
|---|---|---|---|---|
| 7,752,860 | B2 * | 7/2010 | Manole | F28D 5/02 62/304 |
| 9,297,565 | B2 * | 3/2016 | Hung | F25B 45/00 |
| 9,765,987 | B2 * | 9/2017 | Grabon | F24F 11/83 |
| 9,802,458 | B2 * | 10/2017 | Harke | B60H 1/3202 |
| 10,619,898 | B2 * | 4/2020 | Hollander | F24F 5/0035 |
| 10,808,976 | B2 * | 10/2020 | Watanabe | F25B 41/24 |
| 2010/0212346 | A1 * | 8/2010 | Bourne | F28D 5/00 62/291 |

* cited by examiner

AIR CONDITIONER

CROSS-REFERENCE TO RELATED APPLICATION(S)

This application claims priority under 35 U.S.C. § 119 to Korean Application No. 10-2020-0175433 filed on Dec. 15, 2020, whose entire disclosure is hereby incorporated by reference.

BACKGROUND

1. Field

An air conditioner, and more particularly, a heat exchanger are disclosed herein.

2. Background

An air conditioner, which is an apparatus that supplies hot/cool air, dehumidified air, and humidified air to an interior space of a house or building, for example, has a refrigeration cycle for heat exchange of inflowing air. An air conditioner for ventilation that continuously draws in external fresh air into an interior space of a house or building, for example, to exchange with contaminated interior air has a problem in that a considerable amount of condensate water is not used and discarded to the outside in the process of continuously cooling external air flowing inside for cooling and dehumidification. Further, there is a problem in that as high-humidity external air continuously flows inside, excessive cooling performance is required to cool the external air to a dew point temperature in the process of dehumidifying and supplying the external air.

An air conditioner that improves heat exchange efficiency using a heat exchanger for ventilation and waste heat recovery in a heat exchange process has been disclosed in Korean Patent No. 10-0902502, which is hereby incorporated by reference; however, heat exchange should occur between exterior air and interior air to recovery waste heat, so there is a problem in that a plurality of channels should be provided. Further, an air conditioner that improves heat exchange efficiency by recovering waste heat of circulation air which is discharged outside has been disclosed in Korean Patent No. 10-1337942, which is hereby incorporated by reference; however, there is a problem in that there is no plan for using condensate water.

BRIEF DESCRIPTION OF THE DRAWINGS

Embodiments will be described in detail with reference to the following drawings in which like reference numerals refer to like elements, and wherein.

DETAILED DESCRIPTION

Figure 1:
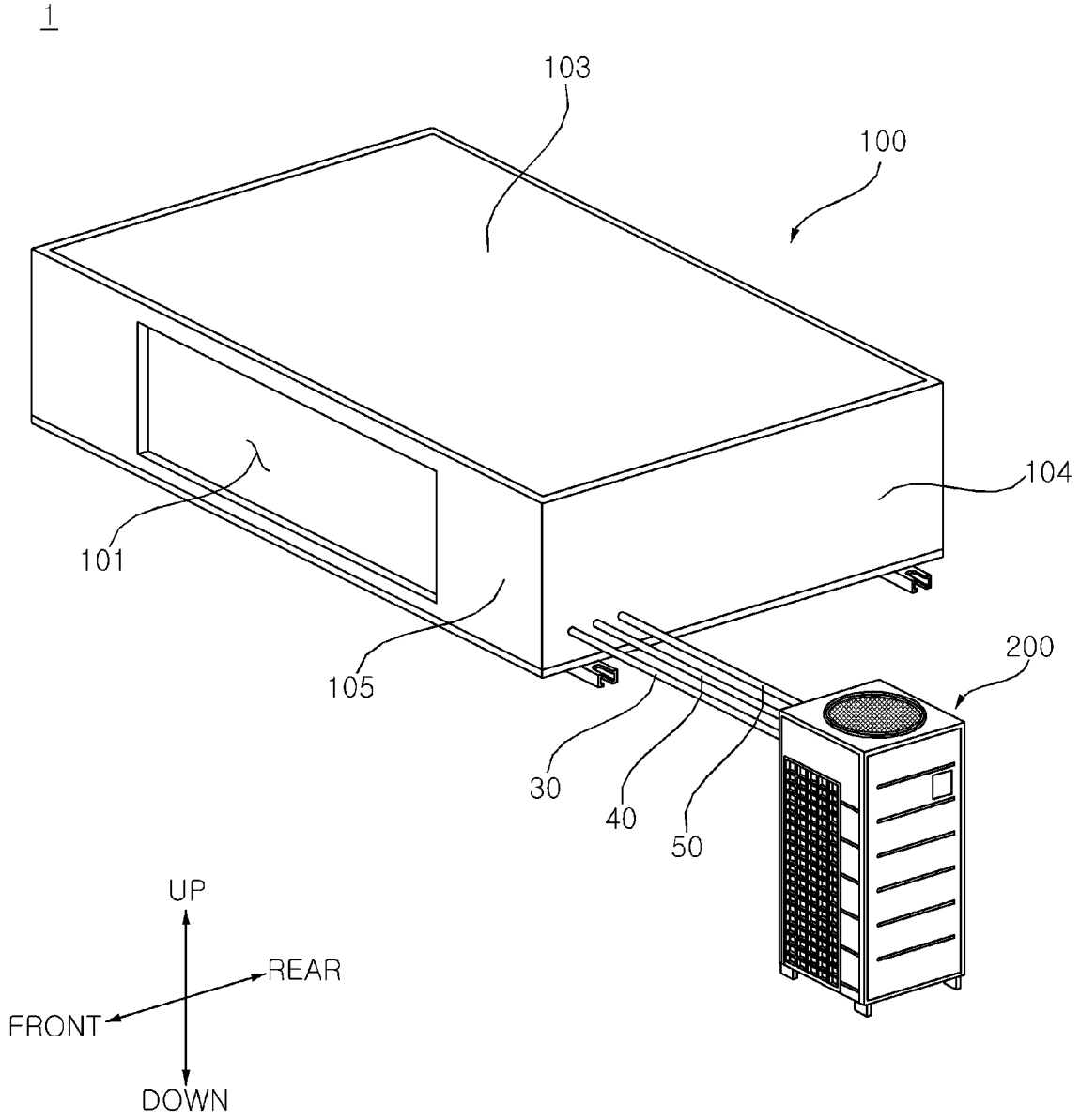
FIG. 1 is a perspective view of an air conditioner according to an embodiment.

Advantages and features of embodiments, and methods of achieving them will be clear by referring to the embodiments described hereinafter with reference to the accompanying drawings. However, the embodiments are not limited to the embodiments described hereinafter and may be implemented in various ways, and the embodiments are provided to complete the description and let those skilled in the art completely know the scope and embodiments are defined by claims. Like reference numerals indicate like components throughout the specification.

Hereinafter, embodiments will be described with reference to the drawings illustrating an air conditioner according to embodiments.

An entire configuration of air conditioner 1 according to an embodiment is described first with reference to FIG. 1. FIG. 1 is a perspective view of an air conditioner with an indoor unit and an outdoor unit connected to each other obliquely seen from above.

Air conditioner 1 includes indoor unit 100 having an air inlet 101 and an air outlet 102 (see FIG. 3), and an outdoor unit 200 connected with the indoor unit 100 through pipes 30, 40, and 50. The indoor unit 100 may be disposed at an interior space of a house or building, for example, and the outdoor unit 200 may be disposed at an outdoor space. However, disposition of the indoor unit 100 and the outdoor unit 200 is not limited thereto, and the indoor unit 100 and the outdoor unit 200 may both be disposed in an outdoor space.

An entire external shape of the indoor unit 100 may be a quadrangular prism. The indoor unit 100 may include a top cover 103 forming the top of the indoor unit 100; a side panel 104 connected with the top cover 103; and a front panel 105 forming the front of the indoor unit 100. The top cover 103, side panel 104, and front panel 105 may form outer surfaces of the indoor unit 100 and each may be formed in a plate shape.

The air inlet 101 may be formed at the front panel 105 to be open forward and rearward. External air may flow into the indoor unit 100 through the air inlet 101.

The outdoor unit 200 may be connected with the indoor unit 100 through refrigerant pipes 30, 40, and 50 through which refrigerant flows. The indoor unit 100 and the outdoor unit 200 may send/receive refrigerant to/from each other through the refrigerant pipes 30, 40, and 50.

Figure 2:
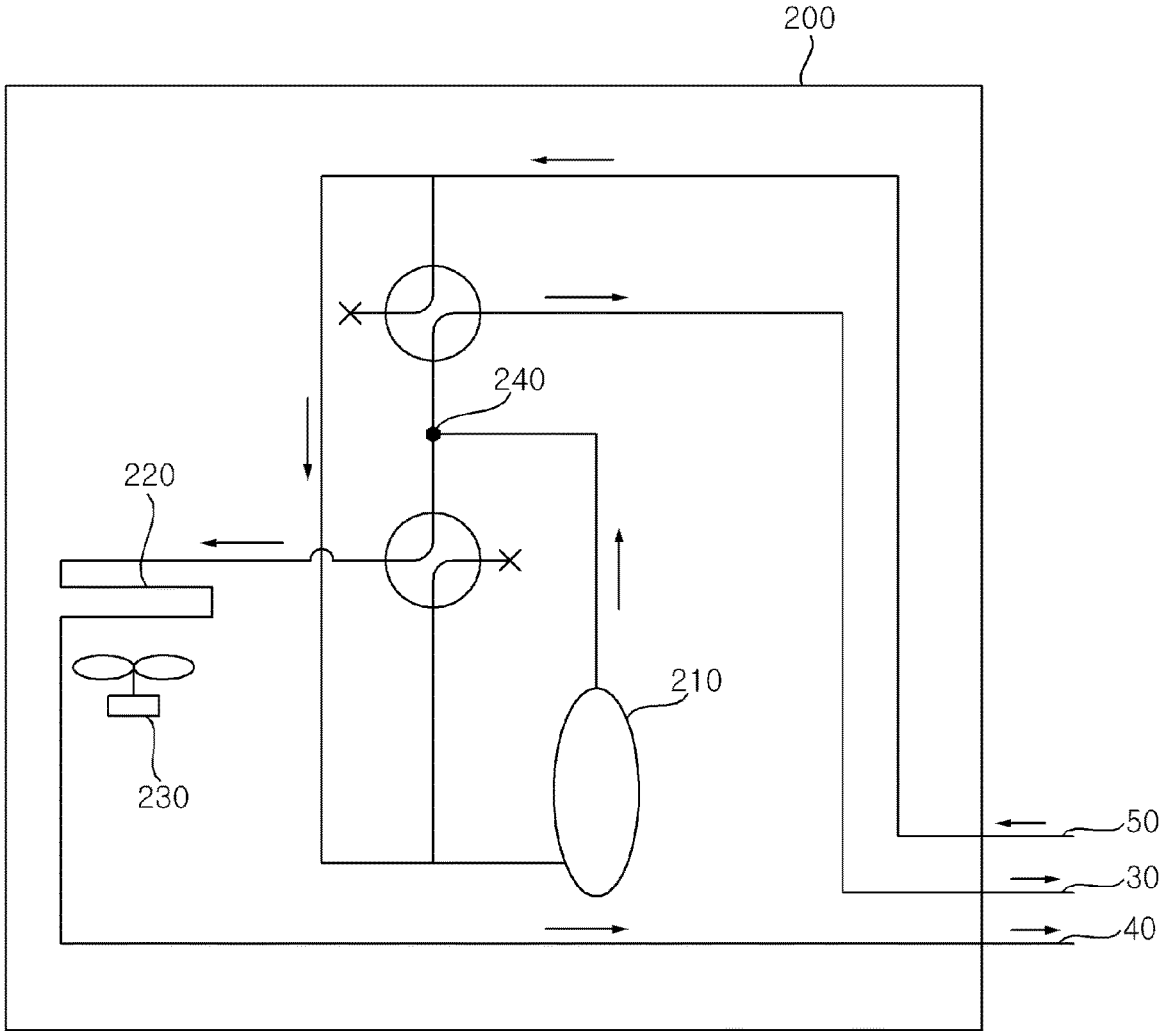
FIG. 2 is a schematic diagram showing flow of refrigerant in an outdoor unit according to an embodiment.

Hereafter, an internal structure of the outdoor unit 200 is described with reference to FIG. 2. FIG. 2 shows the internal configuration and refrigerant flow of the outdoor unit 200 when the air conditioner 1 is operated in a cooling mode.

The outdoor unit 200 may include a compressor 210 that compresses refrigerant, an outdoor heat exchanger 220 that heat exchanges refrigerant discharged from the compressor 210, and an outdoor fan 230 that blows external air to the outdoor heat exchanger 220. The compressor 210 compresses and discharges refrigerant flowing therein in a high-temperature and high-pressure state, and may be connected with the outdoor heat exchanger 220 and the indoor unit 100.

The outdoor heat exchanger 220 heat exchanges refrigerant discharged from the compressor 210 with external air. When the air conditioner 1 is operated in a cooling mode, the outdoor heat exchanger 220 may discharge heat to external air. When the air conditioner 1 is operated in a heating mode, the outdoor heat exchanger 220 may absorb heat from external air. The outdoor fan 230 may be disposed adjacent to the outdoor heat exchanger 220 and blow external air to the outdoor heat exchanger 220.

The outdoor unit 200 may be connected with the indoor unit 100 through first pipe 30 through which refrigerant discharged from the compressor 210 flows, and second pipe 40 through which refrigerant discharged from the outdoor heat exchanger 220 flows. The outdoor unit 200 may be connected with the indoor unit 100 through third pipe 50 through which refrigerant at a low pressure flows.

When the air conditioner 1 is operated in the cooling mode, a first portion of the refrigerant discharged from the compressor 210 may be divided at a refrigerant divergence point 240 and supplied to the indoor unit 100 through the first pipe 30. The refrigerant flowing through the first pipe 30 may be refrigerant compressed at high temperature and high pressure.

When the air conditioner 1 is operated in the cooling mode, a second portion of the refrigerant divided at the refrigerant divergence point 240 may flow to the outdoor heat exchanger 220. The refrigerant flowing into the outdoor heat exchanger 220 may be condensed by exchanging heat with external air and then supplied to the indoor unit 100 through the second pipe 40. The refrigerant flowing through the second pipe 40 may be refrigerant condensed through the outdoor heat exchanger 220 after being compressed through the compressor 210.

When the air conditioner 1 is operated in the cooling mode, refrigerant that has exchanged heat through a main heat exchanger 120 disposed in the indoor unit 100 may flow into the outdoor unit 200 through the third pipe 50. The refrigerant flowing in the outdoor unit 200 through the third pipe 50 may flow to the compressor 210 and may be compressed by the compressor 210.

When the air conditioner 1 is operated in the heating mode, the refrigerant discharged from the compressor 210 may be entirely supplied to the indoor unit 100 through the first pipe 30 without diverging at the refrigerant divergence point 240. When the air conditioner 1 is operated in the heating mode, refrigerant that has exchanged heat through the main heat exchanger 120 disposed in the indoor unit 100 may flow into the outdoor unit 200 through the second pipe 40. The refrigerant flowing in the outdoor unit 200 through the second pipe 40 may flow to the outdoor heat exchanger 220, and may evaporate through the outdoor heat exchanger 220 and then flow into the compressor 210.

Figure 3:
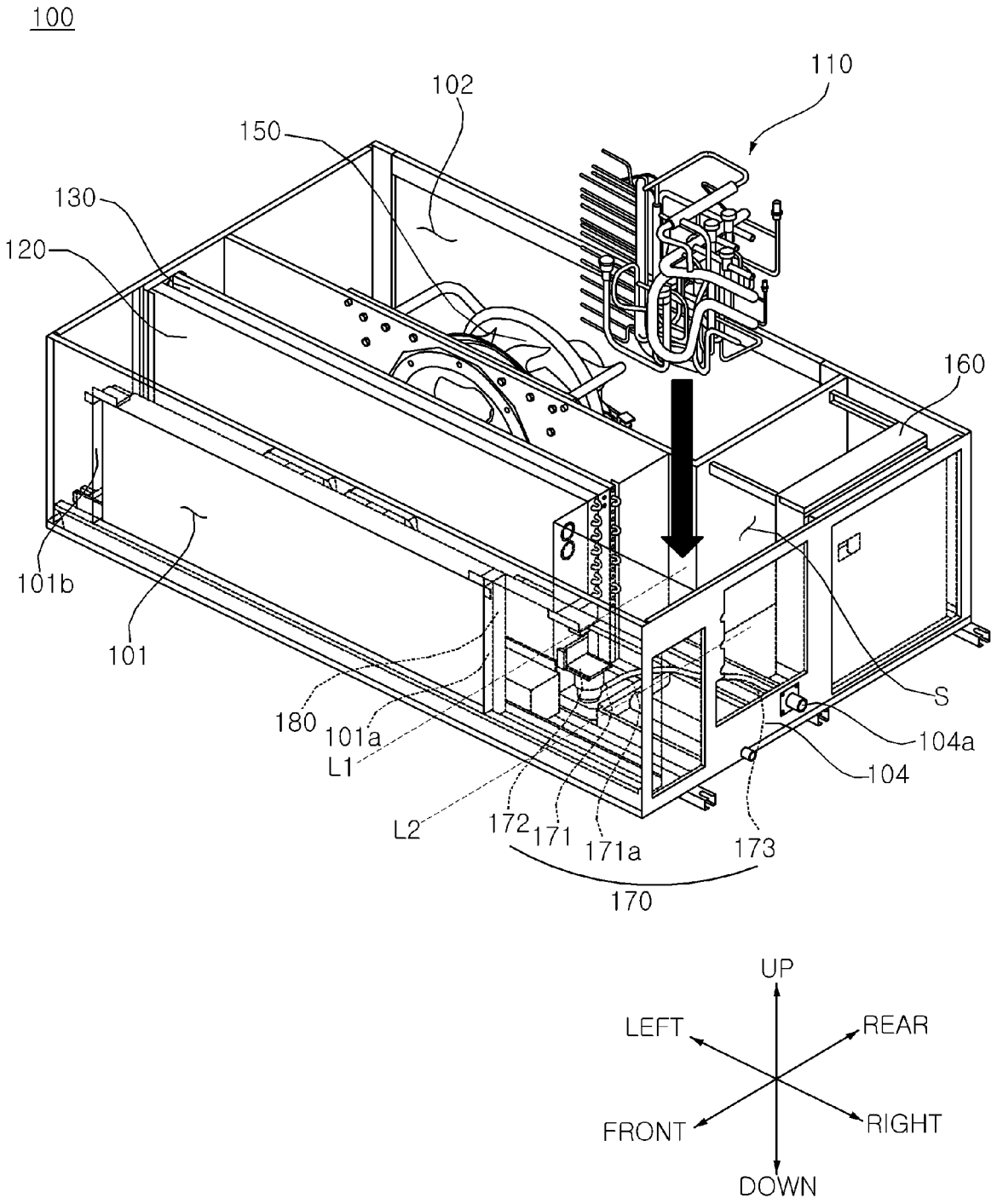
FIG. 3 is an exploded perspective view of an indoor unit according to an embodiment.

Hereafter, internal structure of the indoor unit 100 is described with reference to FIG. 3. FIG. 3 shows an inside of the indoor unit 100 with the top cover 103 and a waste heat exchanger 140 (see FIG. 5) separated therefrom.

The air inlet 101 through which external air flows inside and the air outlet 102 through which the air flowing inside through the air inlet 101 is supplied to the interior may be formed at the indoor unit 100. In the air conditioner 1 according to an embodiment, the air inlet 101 is open to an outdoor space, so that external air may be continuously supplied through the air inlet 101.

The indoor unit 100 may include a switch unit or switch 110 that is disposed in the indoor unit 100 and connected with the first pipe 30 and the second pipe 40; the main heat exchanger 120 that exchanges heat with the air flowing inside through the air inlet 101 and is connected with the second pipe 40; a reheat exchanger 130 that is disposed at a downstream side of the main heat exchanger 120 and connected with the first pipe 30; an indoor fan 150 that blows the air flowing inside through the air inlet 101 to the air outlet 102; a controller 160 that controls operation of the switch unit 110, the indoor fan 150, the compressor 210, and the outdoor fan 230; a drain unit or drain 170 that circulates condensate water produced at the main heat exchanger 120; and a filter 180 that filters out foreign substances contained in the air that flows inside through the air inlet 101.

The switch unit 110 may be connected with the first pipe 30, the second pipe 40, and the third pipe 50. The switch unit 110 may control flow of refrigerant in the first pipe 30, the second pipe 40, and the third pipe 50. The switch unit 110 may change a flow direction of refrigerant flowing in the first pipe 30, the second pipe 40, and the third pipe 50, depending on the cooling and heating modes.

The switch unit 110 may change the cooling and heating modes of the air conditioner 1. When the air conditioner 1 is operated in the cooling mode, the switch unit 110 may supply refrigerant, which is discharged at high temperature and high pressure from the compressor 210, to the reheat exchanger 130. When the air conditioner 1 is operated in the heating mode, the switch unit 110 may supply refrigerant, which is discharged at high temperature and high pressure from the compressor 210, to the main heat exchanger 120.

The switch unit 110 may be disposed in space S formed between the heat exchangers 120, 130, and 140 and the side panel 104. The switch unit 110 may be described in a different was as being disposed in the space S formed outside of a channel formed between the air inlet 101 and the air outlet 102.

The main heat exchanger 120 heat exchanges the air flowing inside through the air inlet 101 and refrigerant and is disposed at a downstream side of the air inlet 101. The main heat exchanger 120 may be disposed to face the air inlet 101. The main heat exchanger 120 may absorb heat from the air flowing inside through the air inlet 101 in the cooling mode and supply heat to the air flowing inside through the air inlet 101 in the heating mode.

The reheat exchanger 130 heat exchanges the air flowing inside through the air inlet 101 and refrigerant and is disposed at a downstream side of the main heat exchanger 120. The reheat exchanger 130 may be disposed to face the main heat exchanger 120. The reheat exchanger 130 may supply heat to the air that has passed through the main heat exchanger 120 in the cooling mode and may not operate in the heating mode.

The indoor fan 150 may be disposed at a downstream side of the reheat exchanger 130 and provide a suction force so that external air may be guided into the indoor unit 100 through the air inlet 101 and may be discharged through the air outlet 102.

The controller 160 may be disposed outside of the channel formed between the air inlet 101 and the air outlet 102. The controller 160 may control whether to operate the indoor fan 150 and the outdoor fan 230 and an operation intensity of the fans. The controller 160 may control the cooling and heating modes of the air conditioner 1 by controlling the switch unit 110. The controller 160 may adjust an operation frequency of the compressor 210.

The filter 180 may be disposed at the air inlet 101 and may filter out foreign substances passing through the air inlet 101. The filter 180 may be a pre-filter and may be manufactured in a shape corresponding to the air inlet 101.

The drain unit 170 may include a drain pan 171 in which condensate water produced at the main heat exchanger 120 is collected; a pump 172 that pumps out the condensate water collected in the drain pan 171; and a drain pipe 173 through which the condensate water collected in the drain pan 171 is pumped out of the indoor unit 100. The drain pan 171 may be a water tank having a rectangular prism shape and open on a top. The drain pan 171 may be spaced downward apart from the main heat exchanger 120 and may be disposed to cover a lower portion of the main heat exchanger 120.

At least a portion of the drain pan 171 may be disposed outside of the channel formed between the air inlet 101 and the air outlet 102. At least a portion of the drain pan 171 may protrude toward the space S in which the switch unit 110 is disposed.

The air inlet 101 may be formed at the front panel 105 to be open forward and backward, and may have a first boundary 101*a* and a second boundary 101*b* formed opposite the first boundary 101*a*. The air inlet 101 may be elongated laterally between the first boundary 101*a* and the second boundary 101*b* in FIG. 3.

At least a portion of the drain pan 171 may be disposed outside of or laterally beyond the first boundary 101*a*, and may protrude laterally beyond the first boundary 101*a*, as shown in FIG. 3. A drain pan side wall 171*a* disposed to face the side panel 104 may be positioned outside of or laterally beyond the first boundary 101*a*.

The pump 172 may be disposed inside of the drain pan 171 and may supply the condensate water collected in the drain pan 171 to the waste heat exchanger 140 (see FIG. 5) described hereinafter. The pump 172 may be disposed outside of the channel formed between the air inlet 101 and the air outlet 102. The pump 172 may be disposed outside of or laterally beyond the first boundary 101*a*, and may be spaced laterally apart from the first boundary 101*a*, as shown in FIG. 3.

In order to describe positions of the drain pan 171 and the pump 172, a line extending forward and backward from the first boundary 101*a* is defined as a first line L1 and a line extending forward and backward from the drain pan side wall 171*a* is defined as a second line L2. The second line L2 may be formed outside (at a right side in FIG. 3) of or laterally beyond the first line L1. At least a portion of the drain pan 171 may be disposed between the first line L1 and the second line L2 and some of the condensate water may be collected between the first line L1 and the second line L2. The pump 172 may be disposed between the first line L1 and the second line L2.

According to this structure, air that flows toward the air outlet 102 after flowing inside through the air inlet 101 does not interfere with the drain unit 170. Accordingly, flow resistance that is applied to the air that flows toward the air outlet 102 after flowing inside through the air inlet 101 is minimized, whereby it is possible to improve blowing performance.

The drain pipe 173 may be connected with the pump 172 and extend toward the side panel 104 and may be connected with the side panel 104. A water discharge port 104*a* through which condensate water, which flows in the drain pipe 173, out of the indoor unit 100 may be discharged, may be formed at the side panel 104. The water discharge port 104*a* may protrude from the side panel 104.

Figure 4:
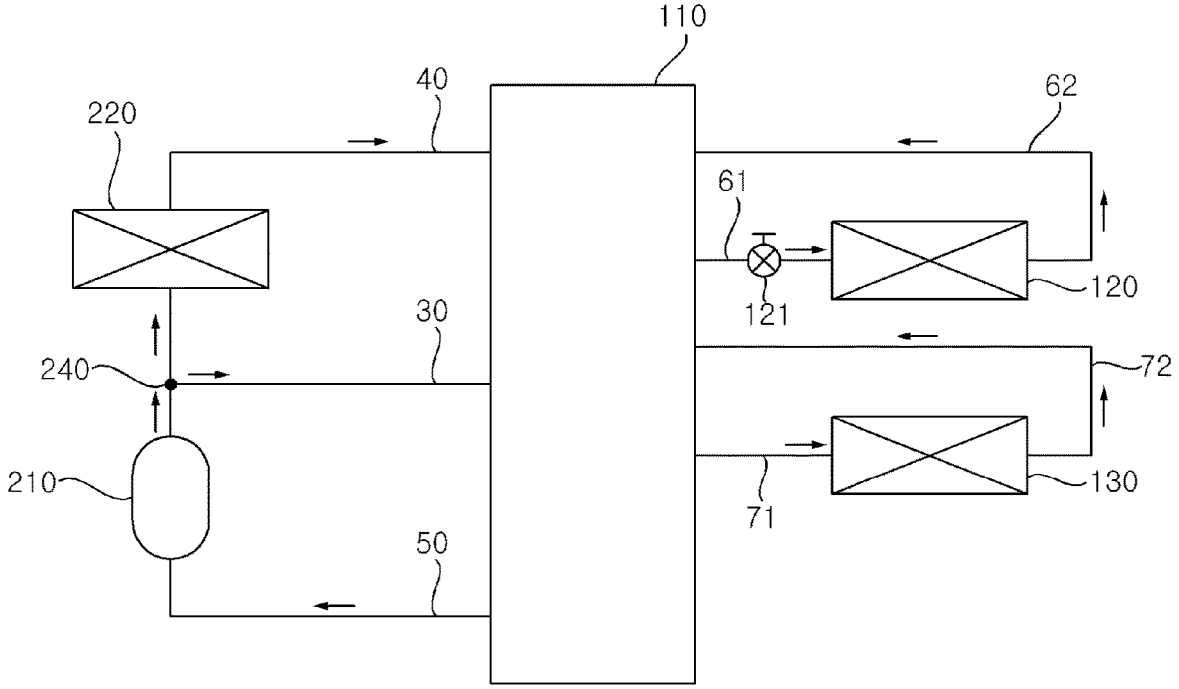
FIG. 4 is a schematic diagram showing flow of refrigerant according to an embodiment.

The refrigeration cycle when the air conditioner 1 is operated in the cooling mode is described hereafter with reference to FIG. 4. FIG. 4 shows the flow of refrigerant in the cooling mode.

The refrigerant at high temperature and high pressure discharged from the compressor 210 is divided at the refrigerant divergence point 240, flows into the outdoor heat exchanger 220, and is condensed therein. The refrigerant flowing and condensed in the outdoor heat exchanger 220 flows into the switch unit 110 through the second pipe 40. The refrigerant flowing in the switch unit 110 through the second pipe 40 flows into the main heat exchanger 120 through a first main channel 61 and is evaporated therein. An expansion valve 121 that expands the refrigerant that flows into the main heat exchanger 120 may be disposed in the first main channel 61 and may expand the refrigerant flowing through the first main channel 61, or may be disposed in the switch unit 110. The refrigerant evaporating in the main heat exchanger 120 flows into the switch unit 110 through a second main channel 62. The refrigerant flowing in the switch unit 110 flows into the compressor 210 through the third pipe 50.

The refrigerant at high temperature and high pressure discharged from the compressor 210 is divided at the refrigerant divergence point 240 and flows into the switch unit 110 through the first pipe 30. The refrigerant flowing in the switch unit 110 through the first pipe 30 flows into the reheat exchanger 130 through a first reheat channel 71 and is condensed therein. The refrigerant condensed in the reheat exchanger 130 flows into the switch unit 110 through a second reheat channel 72. The refrigerant flowing in the switch unit 110 through the second reheat channel 72 joins the first main channel 61 and then flows into the main heat exchanger 120.

Figure 5:
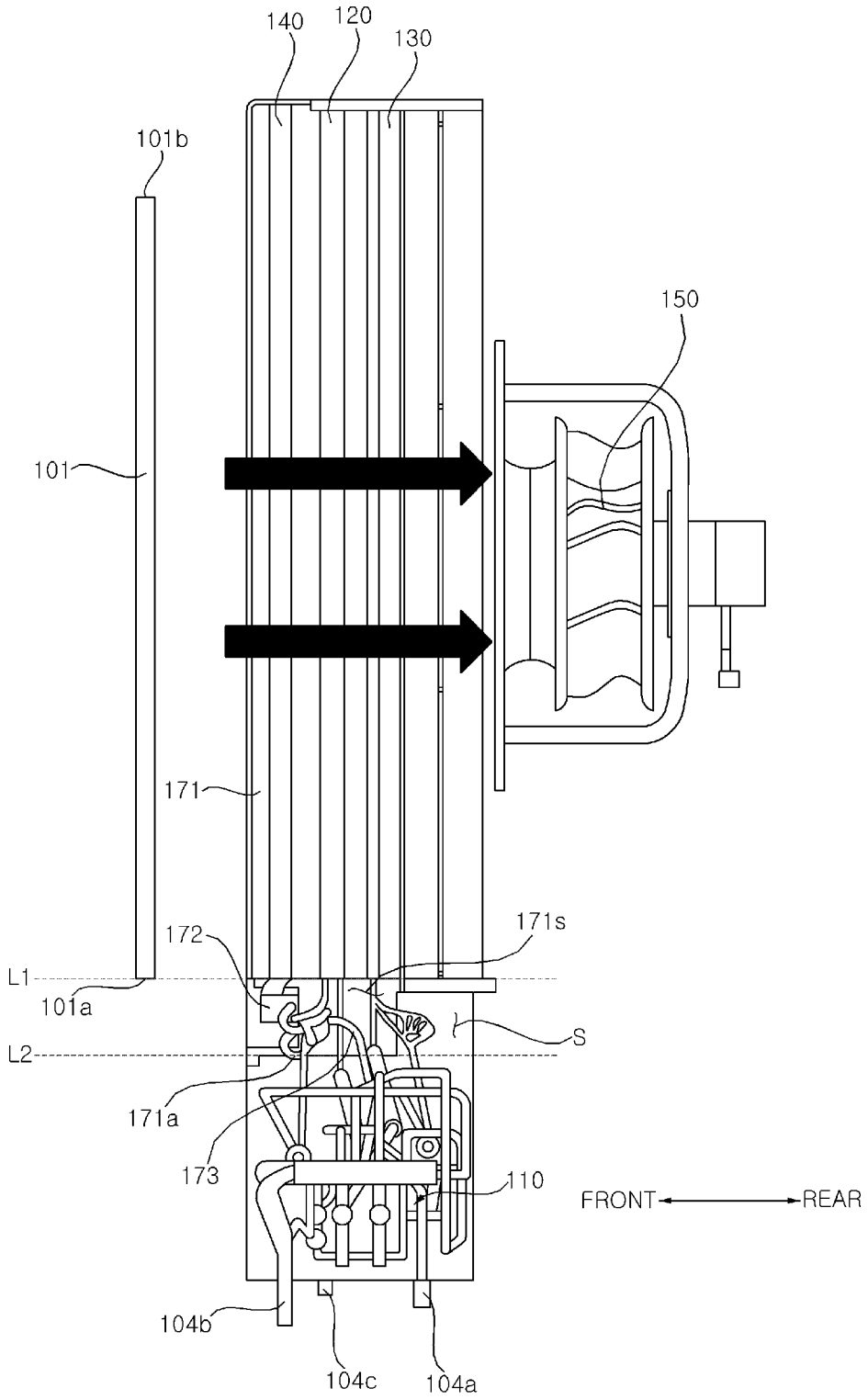
FIG. 5 is a portion of an opened-up plan view of the indoor unit according to an embodiment.

The waste heat exchanger 140 and the drain unit 170 is described hereafter with reference to FIG. 5. FIG. 5 is a view of the heat exchangers 120, 130, and 140, the switch unit 110, the drain unit 170, and the indoor unit 150 viewed from above.

The waste heat exchanger 140 that heat exchanges the air flowing inside through the air inlet 101 and the condensate water produced at the main heat exchanger 120 with each other is disposed at the upstream side of the main heat exchanger 120. The waste heat exchanger 140 may be disposed to face the air inlet 101 and may be disposed in parallel with the main heat exchanger 120.

The waste heat exchanger 140 may be disposed in parallel with the main heat exchanger 120 and the reheat exchanger 130 and may be spaced apart from the main heat exchanger 120 at the upstream side. The main heat exchanger 120 may be spaced apart from the reheat exchanger 130 and the waste heat exchanger 140 between the heat exchangers 130 and 140. The indoor fan 150 may be spaced apart from the reheat exchanger 130 at the downstream side and an inside side thereof may extend in parallel with the air inlet 101.

The drain pan 171 may be disposed to cover lower portions of the main heat exchanger 120, the reheat exchanger 130, and the waste heat exchanger 140. At least a portion of the drain pan 171 may protrude toward the space S in which the switch unit 110 is disposed.

At least a portion of the drain pan 171 and the pump 172 may be disposed outside of the channel that passes through the air inlet 101, the waste heat exchanger 140, the main heat exchanger 120, the reheat exchanger 130, and the indoor fan 150. This may mean that at least a portion of the drain pan 171 and the pump 172 are disposed outside of the first line L1, described above with reference to FIG. 3.

The drain pan side wall 171*a* may be disposed outside of or laterally beyond the air inlet 101 and a drain portion 171*s* in which the pump 172 is disposed may be formed at the drain pan 171. The drain portion 171*s* may mean an internal space of the drain pan 171 which is formed between the first line L1 and the second line L2. The drain portion 171*s* may mean an internal space of the drain pan 171 which is positioned outside of or laterally beyond the air inlet 101 or may mean the internal space of the drain pan 171 that protrudes toward the space S in which the switch unit 110 is disposed. Accordingly, at least a portion of the drain pan 171 and the pump 172 may be disposed together with the switch unit 110 in the space S. According to this structure, the pump 172 and pipes 141, 142 and 173 connected with the pump 172 may not interfere with the air flowing in the indoor unit 100.

The water discharge port 104*a* may be connected with the drain pipe 173, a first port 104*b* may be connected with the first pipe 30, and a second port 104*c* may be connected with the second pipe 40.

Figure 6:
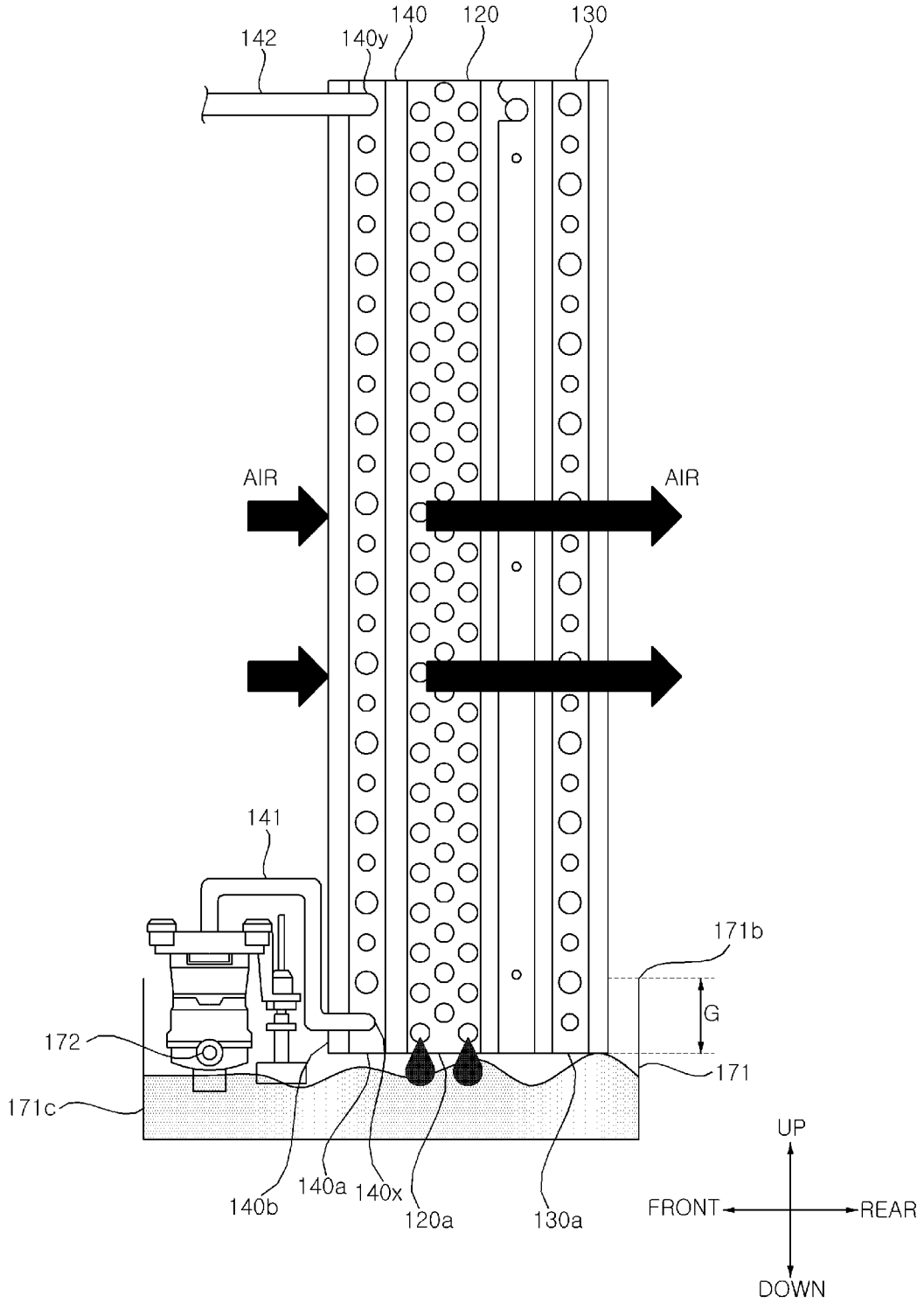
FIG. 6 is a portion of an opened-up side view of the indoor unit according to an embodiment.

Hereafter, structure and a connection relationship of the heat exchangers 120, 130, and 140 and the drain unit 170 are described with reference to FIG. 6. FIG. 6 is a view of the heat exchangers and the drain unit viewed from a side.

The waste heat exchanger 140, the main heat exchanger 120, and the reheat exchanger 130 may be spaced apart from each other in a forward and backward direction, and may be elongated a same length in a vertical direction. The air flowing inside through the air inlet 101 may be primarily cooled by exchanging heat with condensate water through the waste heat exchanger 140, may be cooled and dehumidified by exchanging heat with refrigerant through the main heat exchanger 120, and then may exchange heat with refrigerant through the reheat exchanger 130, whereby the air may be discharged through the air outlet 102 in a heated state.

The reheat heat exchanger 140 may be disposed between the main heat exchanger 120 and the pump 172. The pump 172 may be disposed between the air inlet 101 and the reheat heat exchanger 140. The pump 172 may be disposed between a front wall 171*c* of the drain pan 171 and the reheat heat exchanger 140. The pump 172 may be disposed between the front wall 171*c* of the drain pan 171 and a front surface 140*b* of the reheat heat exchanger 140.

The waste heat exchanger 140 may be disposed such that at least a portion thereof is positioned inside of the drain pan 171. A lower portion of the waste heat exchanger 140 may be disposed inside of the drain pan 171 and a (third) lower end 140*a* of the waste heat exchanger 140 may be positioned lower than an upper end edge 171*b* of the drain pan 171. The third lower end 140*a* of the waste heat exchanger 140 may be positioned to be spaced downward apart from the upper end edge 171*b* of the drain pan 171 with a predetermined distance G therebetween.

The main heat exchanger 120 may be disposed such that at least a portion thereof is positioned inside of the drain pan 171. A lower portion of the main heat exchanger 120 may be disposed inside of the drain pan 171 and a (first) lower end 120*a* of the main heat exchanger 120 may be positioned lower than the upper end edge 171*b* of the drain pan 171. The (first) lower end 120*a* of the main heat exchanger 120 may be positioned to be spaced downward apart from the upper end edge 171*b* of the drain pan 171 with the predetermined distance G therebetween.

The reheat exchanger 130 may be disposed such that at least a portion thereof is positioned inside of the drain pan 171. A lower portion of the reheat exchanger 130 may be disposed inside the drain pan 171 and a (second) lower end 130*a* of the reheat exchanger 130 may be positioned lower than the upper end edge 171*b* of the drain pan 171. The (second) lower end 130*a* of the reheat exchanger 130 may be positioned to be spaced downward apart from the upper end edge 171*b* of the drain pan 171 with the predetermined distance G therebetween. According to the structure described above, it is possible to prevent the condensate water produced at the heat exchangers 120, 130, and 140 from leaking outside and it is possible to easily manage the condensate water.

The waste heat exchanger 140 may be supplied with condensate water through an inlet 140*x* formed at the lower portion thereof and may discharge condensate water through an outlet 140*y* formed at an upper portion thereof. The inlet 140*x* and the outlet 140*y* may be understood as through-holes that are open to cross the waste heat exchanger 140.

The pump 172 may be connected with delivery pipe 141 that supplies condensate water to the waste heat exchanger 140 and the delivery pipe 141 may be connected to the inlet 140*x* of the waste heat exchanger 140, thereby being able to supply condensate water to the waste heat exchanger 140. The condensate water flowing in the waste heat exchanger 140 through the inlet 140*x* may pass through a zigzag condensate water channel and then may be discharged out of the waste heat exchanger 140 through the outlet 140*y*. The condensate water discharged out of the waste heat exchanger 140 may be discharged out of the indoor unit 100 through water discharge pipe 142 connected with the outlet 140*y* of the waste heat exchanger 140.

Figure 7:
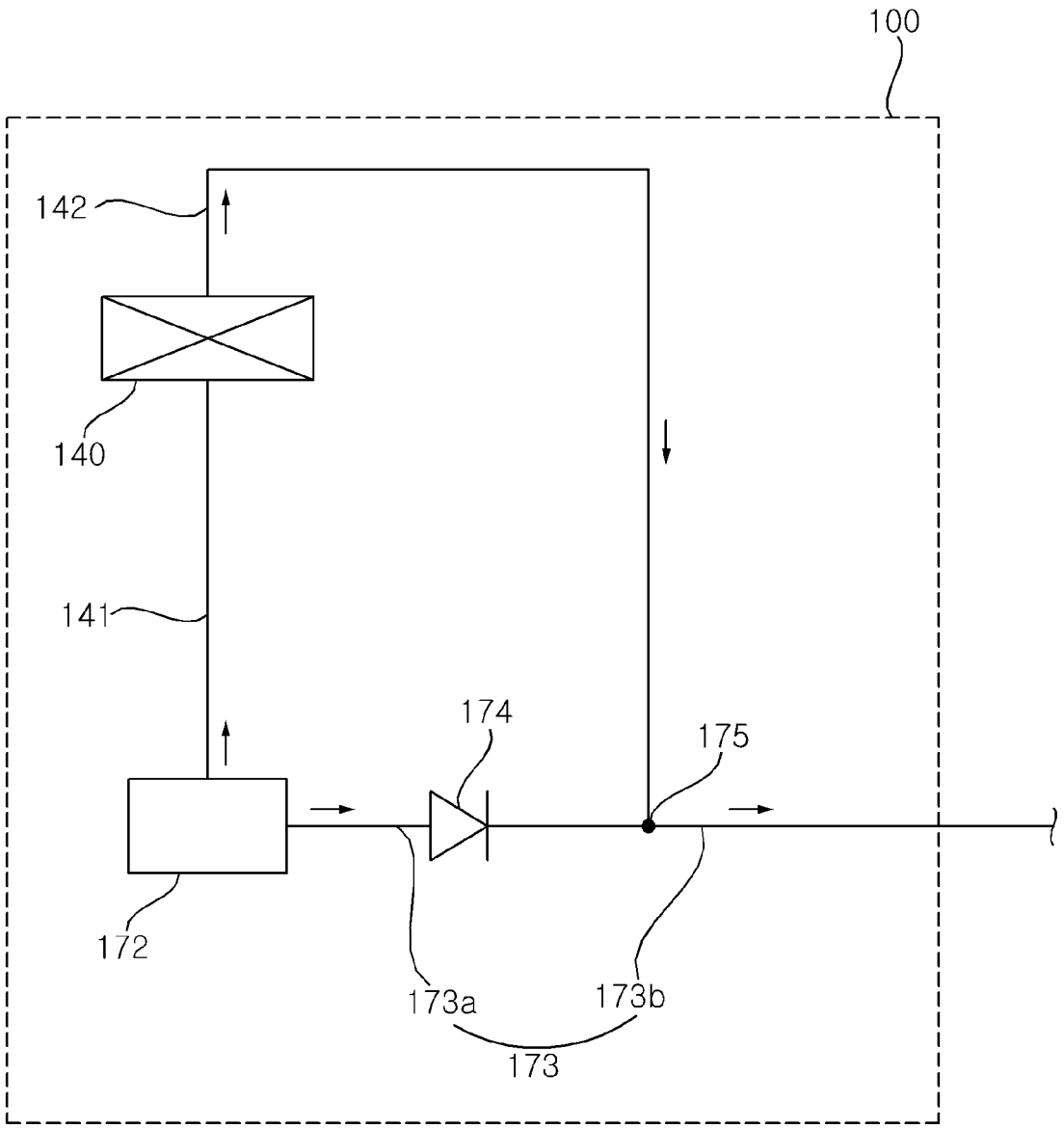
FIG. 7 is a schematic diagram showing flow of condensate water according to an embodiment.

A flow of condensate water is described hereafter with reference to FIG. 7. FIG. 7 shows flow of condensate water collected in the drain pan 171.

Some or a first portion of the condensate water discharged under pressure from the pump 172 may be discharged out of the indoor unit 100 through the drain pipe 173. The remaining or a second portion condensate water discharged under pressure from the pump 172 may be supplied to the waste heat exchanger 140 through the delivery pipe 141, and may be discharged out through the water discharge pipe 142, may join the drain pipe 173 at a condensate water junction 175, and then may be discharged out of the indoor unit 100 after undergoing a heat exchange process in the waste heat exchanger 140.

The drain pipe 173 may include a first drain pipe 173*a* that extends between the pump 172 and the condensate water junction 175, and a second drain pipe 173*b* that extends toward the outside of the indoor unit 100 from the condensate water junction 175. A valve 174 that adjusts flow in the drain pipe 173 may be disposed on the drain pipe 173. The valve 174 may be a check valve that restricts flow in one direction. The valve 174 may be disposed on the first drain pipe 173*a* and may prevent condensate water from flowing to the pump 172 from the condensate water junction 175.

The condensate water discharged under pressure from the pump 172 may flow in two directions to the delivery pipe 141 and the drain pipe 173, or may flow in one direction only to the delivery pipe 141 without flowing to the drain pipe 173. The controller 160 may adjust a flow rate of the condensate water flowing in the drain pipe 173 and the waste heat exchanger 140 by adjusting an opening of the valve 174. The controller 160 control the condensate water discharged under pressure from the pump 172 such that the condensate water entirely flows into the waste heat exchanger 140 without flowing to the drain pipe 173 by fully closing the valve 174. According to the structure described above, it is possible to adjust an amount of heat exchange of the air passing through the waste heat exchanger 140 by adjusting the flow rate of the condensate water flowing into the waste heat exchanger 140.

Figure 8:
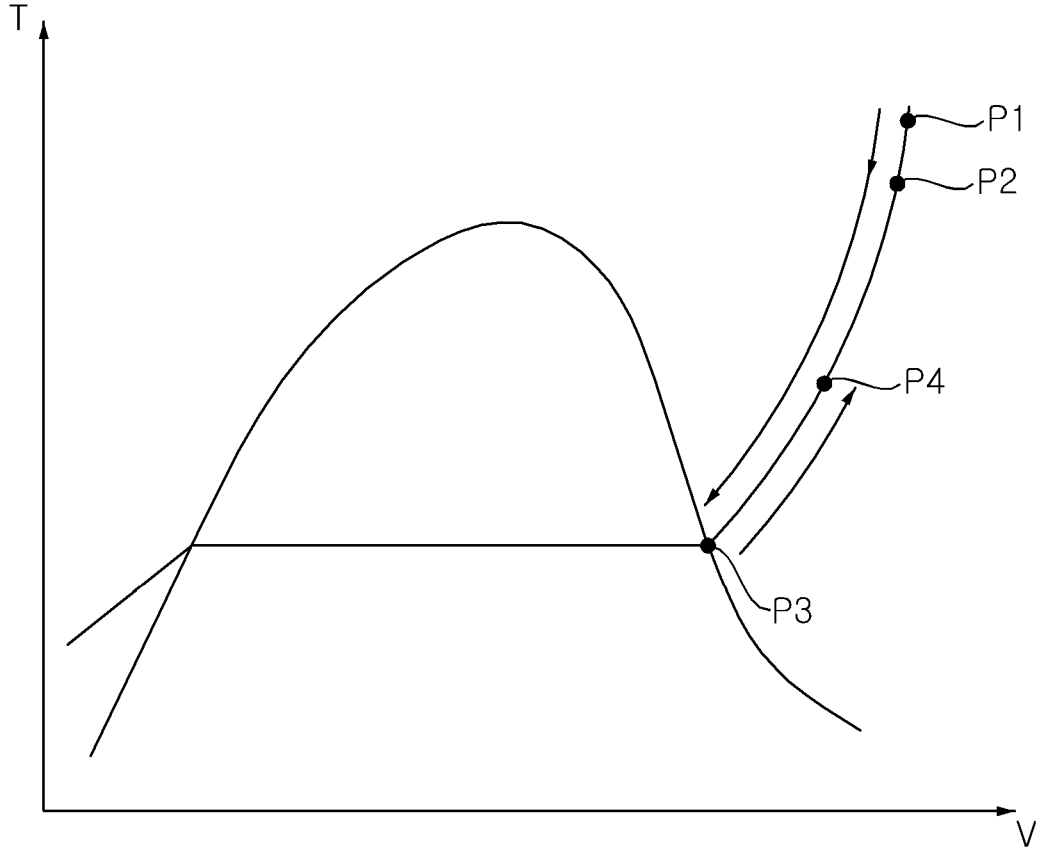
FIG. 8 is a T-V diagram showing properties of flowing air according to an embodiment.

A temperature change of air flowing in the indoor unit 100 through the air inlet 101 in a cooling/dehumidifying mode is described hereafter with reference to FIG. 8. FIG. 8 is a view showing a temperature change of air flowing in the indoor unit 100 when the air conditioner is operated in the cooling/dehumidifying mode as a T-V diagram.

The air flowing inside through the air inlet 101 has properties at a first point P1. The properties of the inflow air at the first point P1 may be the same as those of the external air.

The air flowing in the indoor unit 100 and primarily cooled through the waste heat exchanger 140 has properties at a second point P2. A temperature of the inflow air at the second point P2 may be lower than a temperature at the first point P1.

The air condensed through the main heat exchanger 120 after being primarily cooled through the waste heat exchanger 140 has properties at a third point P3. A temperature of the inflow air at the third point P3 may be lower than the temperature at the second point P2. The temperature of the inflow air at the third point P3 may be a dew point temperature and a gas-state vapor contained in the inflow air may be changed into a liquid state through the main heat exchanger 120 and collected into the drain pan 171. Accordingly, the inflow air may be dehumidified through the main heat exchanger 120.

As air is primarily cooled through the waste heat exchanger 140, the flow rate of air that reaches the dew point temperature at the main heat exchanger 120 increases and an efficiency of cooling and dehumidifying inflow air is improved.

Air heated through the reheat exchanger 130 after being dehumidified through the main heat exchanger 120 has properties at a fourth point P4. A temperature of the inflow air at the fourth point P4 may be higher than the temperature at the third point P3. The temperature at the fourth point P4 may be a desired interior temperature set by a user. The air cooled to the dew point temperature at the third point P3 may be heated up to the desired interior temperature through the reheat exchanger 130 and then supplied to the interior through the air outlet 102.

Embodiments disclosed herein provide an air conditioner that has improved cooling/heating performance. Embodiments disclosed herein further provide an air conditioner that has improved dehumidification efficiency. Embodiments disclosed herein furthermore provide an air conditioner that recovers waste heat of condensate water that is wasted.

Embodiments disclosed herein provide an air conditioner that has a simplified structure for recovering waste heat. Embodiments disclosed herein also provide an air conditioner that minimizes resistance to flowing air. Embodiments disclosed herein additionally provide an air conditioner that has a spatially compact pipeline system.

Advantages are not limited to the advantages described above and other advantages will be clearly understood by those skilled in the art from the description.

Embodiments disclosed herein provide an air conditioner that may include an outdoor unit including a compressor and an outdoor heat exchanger that heat exchanges compressed refrigerant; an indoor unit having an air inlet and an air outlet and connected with the outdoor unit through a first pipe through which refrigerant discharged from the compressor flows and a second pipe through which refrigerant discharged from the outdoor heat exchanger flows; a blowing fan disposed in the indoor unit; a main heat exchanger that heat exchanges air, which flows inside through the air inlet, and connected with the second pipe; a reheat exchanger disposed at a downstream side of the main heat exchanger and connected with the first pipe; and a waste heat exchanger disposed at an upstream side of the main heat exchanger and that exchanging air, which flows inside through the air inlet, and condensate water, which is produced at the main heat exchanger, with each other. Accordingly, it is possible to improve cooling performance by pre-cooling air flowing inside, using condensate water.

The air conditioner may further include a drain unit (drain) that supplies the condensate water produced at the main heat exchanger to the waste heat exchanger, whereby it is possible to continuously smoothly supply condensate water to the waste heat exchanger. The drain unit may include a drain pan in which the condensate water is collected, and a pump that discharges the condensate water collected in the drain pan under pressure, whereby it is possible to continuously smoothly collect and discharge condensate water.

The waste heat exchanger may be disposed such that at least a portion thereof is positioned inside of the drain pan, whereby it is possible to prevent condensate water from leaking out of the drain pan. At least a portion of the drain pan may be disposed outside of a channel formed between the air inlet and the waste heat exchanger, whereby it is possible to minimize flow resistance that is applied to the air flowing inside through the air inlet. The waste heat exchanger may be disposed between the main heat exchanger and the pump, whereby the disposition structure of the drain unit may be made compact.

The pump may be disposed outside of a channel formed between the air inlet and the waste heat exchanger, whereby it is possible to minimize flow resistance that is applied to the air flowing inside the air inlet. The pump may be connected with a delivery pipe configured to supply the condensate water to the waste heat exchanger and a drain pipe configured to discharge the condensate water out of the indoor unit under pressure, whereby condensate water can smoothly circulate.

The condensate water supplied to the waste heat exchanger through the delivery pipe may join the drain pipe, whereby condensate water may be efficiently discharged. A valve that adjusts flow in the drain pipe may be disposed on the drain pipe, whereby it is possible to adjust an amount of heat exchange by adjusting flow in the delivery pipe and the drain pipe. The waste heat exchanger may be supplied with the condensate water through an inlet formed at a lower portion and may discharge the condensate water through an outlet formed at an upper portion, whereby it is possible to minimize a length of a circulation channel of condensate water.

The air conditioner may further include a switch unit disposed in the indoor unit and connected with the first pipe and the second pipe, whereby it is possible to switch cooling and heating modes by adjusting flow of a refrigerant. A space in which the switch unit is disposed may be formed at a side of the waste heat exchanger, and a drain unit (drain)_that supplies the condensate water to the waste heat exchanger may be disposed in the space, whereby it is possible to synthetically manage the switch unit and the drain unit disposed in the same space.

The air flowing inside through the air inlet may be cooled through the waste heat exchanger, dehumidified through the main heat exchanger, and heated through the reheat exchanger, whereby it is possible to supply air cooled and dehumidified through the air conditioner.

According to an air conditioner of embodiments disclosed herein, at least one or more advantages may be achieved as follows.

First, there is an advantage that air flowing inside through the air inlet is primarily cooled before exchanging heat through the main heat exchanger, whereby a cooling and dehumidifying performance is improved.

Second, as reaching a dew point temperature at the main heat exchanger is promoted through primary cooling by the waste heat exchanger, there is another advantage that dehumidifying effect is improved.

Third, there is another advantage that it is possible to improve cooling/heating performance even without a specific waste heat source by using waste heat of condensate water.

Fourth, as the drain unit for circulating condensate water is disposed outside of an air channel, there is another advantage that it is possible to improve cooling/heating performance without reduction of blowing performance.

Fifth, as the drain unit and the switch unit are disposed in the same space, there is another advantage that it is possible to make a product compact and synthetically manage the pipeline.

Embodiments disclosed herein are not limited to those described above and other advantages not stated herein may be made apparent to those skilled in the art from claims.

Although embodiments were illustrated and described above, the embodiments are not limited to the specific exemplary embodiments and may be modified in various ways by those skilled in the art without departing from the scope described in claims, and the modified examples should not be construed independently from the spirit of the scope.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

an outdoor unit including a compressor and an outdoor heat exchanger configured to heat-exchange compressed refrigerant;

an indoor unit having an air inlet and an air outlet, wherein the indoor unit is connected to the outdoor unit by a first pipe through which refrigerant discharged from the compressor flows, and a second pipe through which refrigerant discharged from the outdoor heat exchanger flows;

a blowing fan disposed in the indoor unit;

a main heat exchanger configured to heat-exchange air flowing into the indoor unit through the air inlet, wherein the main heat exchanger is connected with the second pipe;

a reheat exchanger disposed downstream of the main heat exchanger and connected with the second pipe;

a waste heat exchanger disposed upstream of the main heat exchanger, wherein the waste heat exchanger is configured to heat-exchange the air flowing into the indoor unit through the air inlet and condensate water which is produced at the main heat exchanger; and a drain that supplies the condensate water produced at the main heat exchanger to the waste heat exchanger, wherein the drain includes:

a drain pan in which the condensate water is collected a pump that discharges the condensate water collected in the drain pans wherein the main heat exchanger, the reheat exchanger, and the waste heat exchanger are each disposed on an upper side of the drain pan; and wherein the waste heat exchanger is disposed such that at least a portion thereof is positioned inside of the drain pan.

2. The air conditioner of claim 1, wherein at least a portion of the drain pan is disposed outside of a channel formed between the air inlet and the waste heat exchanger.

3. The air conditioner of claim 1, wherein the waste heat exchanger is disposed between the main heat exchanger and the pump.

4. The air conditioner of claim 1, wherein the pump is disposed outside of a channel formed between the air inlet and the waste heat exchanger.

5. The air conditioner of claim 1, wherein the pump is connected with a delivery pipe configured to supply the condensate water to the waste heat exchanger and a drain pipe configured to discharge the condensate water out of the indoor unit.

6. The air conditioner of claim 5, wherein the condensate water supplied to the waste heat exchanger through the delivery pipe thereafter flows to the drain pipe to join the condensate water flowing therethrough.

7. The air conditioner of claim 5, wherein a valve configured to adjust a flow in the drain pipe is disposed at the drain pipe.

8. The air conditioner of claim 1, wherein the waste heat exchanger is supplied with the condensate water through an inlet formed at a lower portion thereof and discharges the condensate water through an outlet formed at an upper portion thereof.

9. The air conditioner of claim 1, further comprising a switch disposed in the indoor unit and connected with the first pipe and the second pipe.

10. The air conditioner of claim 9, wherein a space in which the switch is disposed is formed at a side of the waste heat exchanger, and a drain that supplies the condensate water to the waste heat exchanger is disposed in the space.

11. The air conditioner of claim 1, wherein the waste heat exchanger, the main heat exchanger, and the reheat exchanger are sequentially disposed in a flow direction of air.

12. An air conditioner, comprising:

an outdoor unit including a compressor and an outdoor heat exchanger configured to heat-exchange compressed refrigerant;

an indoor unit having an air inlet and an air outlet, wherein the indoor unit is connected to the outdoor unit by a first pipe through which refrigerant discharged from the compressor flows and a second pipe through which refrigerant discharged from the outdoor heat exchanger flows;

a blowing fan disposed in the indoor unit;

a main heat exchanger configured to heat-exchange air flowing into the indoor unit through the air inlet, wherein the main heat exchanger is connected with the second pipe;

a reheat exchanger disposed downstream of the main heat exchanger and connected with the first pipe;

a waste heat exchanger disposed upstream of the main heat exchanger, wherein the waste heat exchanger is configured to heat-exchange the air flowing into the indoor unit through the air inlet and condensate water which is produced at the main heat exchanger; and a drain that supplies the condensate water produced at the main heat exchanger to the waste heat exchanger, wherein the drain includes a drain pan in which the condensate water is collected, wherein the main heat exchanger, the reheat exchanger, and the waste heat exchanger are disposed such that at least a portion of each is positioned inside of the drain pan, and wherein the drain further includes a pump, and wherein the waste heat exchanger is disposed between the main heat exchanger and the pump.

13. The air conditioner of claim 12, wherein at least a portion of the drain pan is disposed outside of a channel formed between the air inlet and the waste heat exchanger.

14. The air conditioner of claim 12, wherein the pump is disposed outside of a channel formed between the air inlet and the waste heat exchanger.

15. The air conditioner of claim 12, wherein the pump is connected with a delivery pipe configured to supply the condensate water to the waste heat exchanger and a drain pipe configured to discharge the condensate water out of the indoor unit.

* * * * *